United States Patent [19]

Ditto et al.

[11] 4,344,113

[45] Aug. 10, 1982

[54] APPARATUS TO ILLUMINATE A LIQUID DRINK

[75] Inventors: Donald R. Ditto, Rte. 2, Box 60F2, Winnsboro, Tex. 75494; John R. Sparks, Winnsboro, Tex.

[73] Assignee: Donald R. Ditto, Winnsboro, Tex.

[21] Appl. No.: 104,972

[22] Filed: Dec. 18, 1979

[51] Int. Cl.[3] ..... F21V 33/00

[52] U.S. Cl. ..... 362/101; 362/155; 362/205; 362/802; 362/183; 362/318

[58] Field of Search ..... 362/101, 155, 394, 802, 362/205, 183, 318; 200/85 R

[56] References Cited

U.S. PATENT DOCUMENTS

| | | | |
|---|---|---|---|
| 1,699,058 | 1/1929 | Freud | 200/85 R |
| 2,224,319 | 12/1940 | Schroyer | 362/101 |
| 2,532,181 | 11/1950 | Moore | 362/101 |
| 3,240,892 | 3/1966 | Popoff | 200/85 R |
| 3,374,344 | 3/1968 | Rudolph et al. | 362/101 |
| 3,610,762 | 10/1971 | Dugan | 362/101 |
| 3,878,386 | 4/1975 | Douglas | 362/101 |

FOREIGN PATENT DOCUMENTS

| | | | |
|---|---|---|---|
| 430903 | 6/1935 | United Kingdom | 200/85 R |

*Primary Examiner*—Peter A. Nelson

*Attorney, Agent, or Firm*—Larry B. Dwight

[57] ABSTRACT

A device for illuminating a liquid drink for use at a party or a social event to give the appearance of an illuminated liquid. The device has a light adapted to colimate a beam of light through the transparent bottom of the glass receptacle into the liquid and be dispersed therein. Rechargeable or non-rechargeable batteries are secured within the base to act as a power source for the light. A switch means comprising of upwardly contacts to contact a conductive ring of the base of the glass receptacle forms the on or off means for the switch. A modified form would utilize a coaster which may be used with stem ware and would be activated by the weight of the glass upon the coaster. The still modified form would be formed by a manual operated switch which may be used with the light formed in a chamber formed in the box under the glassware. A charger base utilizing inductive principles is used to recharge rechargeable batteries if used in that particular embodiment.

6 Claims, 8 Drawing Figures

APPARATUS TO ILLUMINATE A LIQUID DRINK

TECHNICAL FIELD

The invention relates to apparatus for illuminating a liquid contained in a glass receptacle for decorative and amusement purposes.

In both public and private establishments lighting has become very important in creating an attractive atmosphere at social events. The proper lighting can bring about a more exciting and pleasurable event. In creating the proper lighting, it would be desirable to illuminate liquids which are drunk at parties and social events to create a more festive atmosphere.

DISCLOSURE OF INVENTION

In accordance with the invention, the device comprises a hollow base having an upper lip adapted to grasp the bottom of a transparent receptacle. A transparent receptacle has a ring formed of an electrically conductive material secured to the bottom to aid in securing the glass receptacle to the base. The ring contacts a pair of phosphor bronze contacts which form a switch to the light source secured in the base. A pair of batteries are connected to the switch and light to form a power source within the base. The light is preferably of a special type having a focusing lens formed in the top thereof to colimate the light upwardly through the ring into the glass. The glass and the liquid therein diffuse the light through the liquid making an appearance that the liquid itself is lighted or giving off light.

The batteries may be of a rechargeable type and connected to simple charging circuit and rectifying circuit for recharging the power source.

The secondary coil of the recharging circuit comprises a printed circuit board having a flat helically formed coil printed thereon. The secondary coil has a current formed therein when placed in close proximity to a similar primary coil which is energized by an AC current.

A modified form of the device comprises a glass coaster adapted to fit over the base to receive glassware having a stem or a regular glass such that when the glass is placed on the coaster it engages a switch to turn the light on and illuminate the glass. The stem acts as a conductor of the light up to the liquid. Another form would have a manual switch which may be placed in the bottom of a hollow glass or mug.

A primary object of the invention is to provide an illuminating source which is safe and easy to use which may illuminate the liquid within the glass receptacle for amusing or entertaining guests at a social event or party.

A still further object of the invention is to provide a rechargeable base which may fit on a glass receptacle to illuminate the liquid therein.

Other and further objects will become apparent on studying the detailed description hereinafter following and the drawings annexed hereto.

BRIEF DESCRIPTION OF DRAWINGS

Drawings of three preferred embodiments are annexed hereto so that the invention may be better and fully understood, in which.

Numeral references are used to designate like parts throughout the various figures of the drawings.

DESCRIPTION OF PREFERRED EMBODIMENTS

Figure 1:
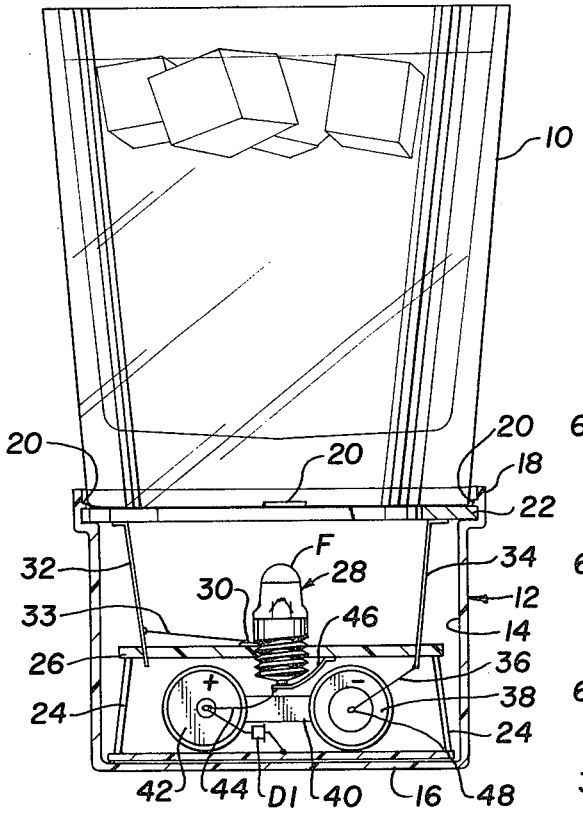
FIG. 1 is an elevational view taken in partial section of the drink illuminating device.

Referring to FIG. 1 of the drawing, a glass receptacle 10 having transparent glass or plastic sides holds a liquid for drinking which may or may not have ice in it. The glass receptacle 10 is adapted to fit on a base 12 having a cylindrically shaped inside bore wall 14 and bottom 16. An upwardly extending lip or flange 18 is formed about the upper periphery of base 12. Two or more ridges 20 are formed on the inside edge of lip 18 and are adapted to grip the bottom of glass receptacle 10 or an annular ring 22 having an opening to the center thereof which is formed of conductive material. The ring 22 is secured to the bottom of the glass receptacle 10 by adhesive or other means.

An electrical base is formed by upwardly extending standards 24 which support a platform 26. A light source such as light bulb 28 is threadly secured in a threaded aperture formed centrally in platform 26. A first contact 30 is secured adjacent the aperture and is adapted to engage the threaded side of light bulb 28. Contact 30 is connected to an upwardly extending contact 32 by wire 34. Contact 32 contacts the annular ring 22 on the glass receptacle 10. A second contact 34 contacts the other side of the ring 22 and is connected to the power source as will be more fully explained hereinafter. Contacts 32 and 34 are preferably constructed of spring-like material such as phosphor bronze. The contacts 32 and 34 are secured in the platform 26 and extend upwardly therefrom. Wire 36 connects contact 34 to a power source such as the negative side of battery 38. The positive end of battery 38 is connected to the negative end of battery 42 by connector 40. The positive side of the battery 42 is connected by wire 44 to contact 46 which engages the base of light bulb 28 to complete the circuit. It should be readily apparent that power from the batteries 38 and 42 is delivered to the light through the conductive ring 22 when the glass is in placed upon the base 12.

Figure 3:
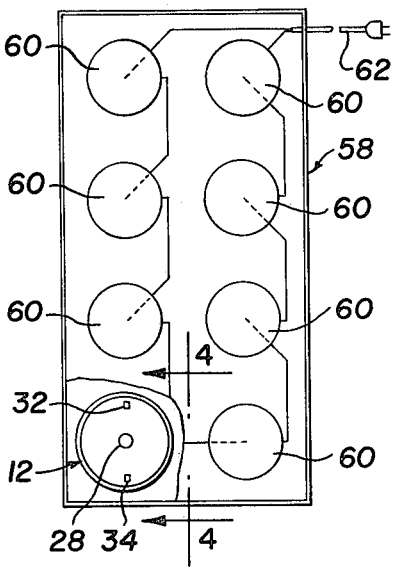
FIG. 3 is a plan view of the charger with parts broken away to more fully illustrate the details of construction.
Figure 5:
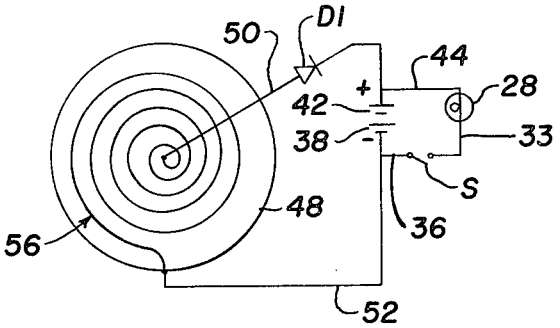
FIG. 5 is a diagrammatic view showing the charging circuit within the base.
Figure 4:
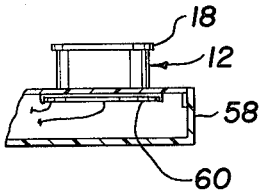
FIG. 4 is a cross-sectional view taken along line 4—4 of FIG. 3.

Batteries 38 and 42 may be of standard penlight or AA dry cell battery. The preferred embodiment of the batteries is a rechargeable type such as a nickel cadmium type battery which may be recharged several times. A recharging circuit forming a secondary coil is assembled within the base 12 and generally comprises a printed circuit board 48 having a plurality of coils 56 printed on the circuit to form a helically-shaped flat coil. The inner end of the coil 56 is connected by wire 50 to a diode D1 which forms a rectifying circuit. The diode D1 is connected to the positive side of battery 42 and a second wire 52 connects the other side of the coil 56 to the negative side of battery 38. Switch means S, such as contacts 32 and 34 in conjunction with the conductive ring 22, is connected in parallel across the batteries 42 and 48. As illustrated in FIGS. 3 through 5, a charging base 58 constructed of insulating material such as plastic has a plurality of primary coils 60 secured on the interior side of base 58 and constructed of printed circuit boards in a similar manner to the secondary coil 48. The primary coils 60 are connected in series to a line cord 62 which may be connected to a standard socket of 110 volts AC. Using eight primary coils 60 produces about a 15 volt drop across each of the coils 60. An AC circuit in a coil produces an expanding and contracting electromagnetic field. A coil of wire such as the secondary coil 48 placed in this electromagnetic field will produce a current across the wires 50 and 52. The current flows through the circuit and is rectified to a single direction by diode D1 to produce a DC current across the batteries 38 and 42. Since the glass 10 will be removed with ring 22, no current passes through light bulb 28.

Figure 2:
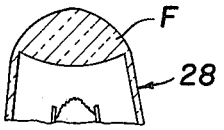
FIG. 2 is an enlarged view of the end of the light.

The light 28 is preferably of a collimated type which would produce a bright light in a single direction. It has been found that a single 250 milliampere bulb having a focusing lens F, as illustrated in FIG. 2, in the end of the lamp 28 produces the desired light qualities.

The charger provides a current of approximately 100 milliamperes or more depending upon the number of coils utilized in the printed circuits and provides ample current for recharging two AA nickel cadmium batteries within 12 to 16 hours.

Figure 8:
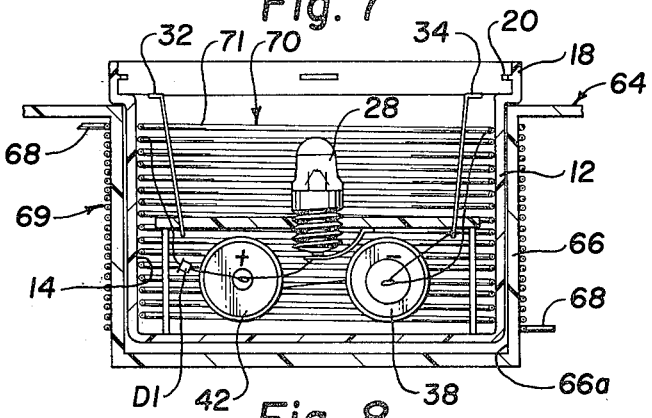
FIG. 8 is a modified form of the charging circuit and device.

An alternate charger is illustrated in FIG. 8 and generally comprises a charger housing 64 having a plurality of recessed pockets 66 formed therein. The pockets 66 are adapted to receive one of the bases 12 of the illuminating device. A primary coil is formed by a fine wire 68 which is coated with a varnish and is wound about the exterior wall 66*a* of pocket 66 to form a helical coil 66*a*. The pockets 66 and coils 69 are arranged in similar manner to the primary coils 60 of the first charger. Wire 68 is connected to the next coil 69. A secondary coil 70 is formed in a similar manner by a fine wire 71 which is wound about the interior coil wall 14 of base 12. Coil 70 is formed in a helical manner and is connected to the positive and negative side of the batteries 38 and 44 with a rectifying diode D1 placed therein. When base 12 is inserted in the pocket 66, the electromagnetic field created by the primary coil 69 forms a current within the secondary coil 70 inside a base 12 to charge the batteries 38 and 42.

Figure 6:
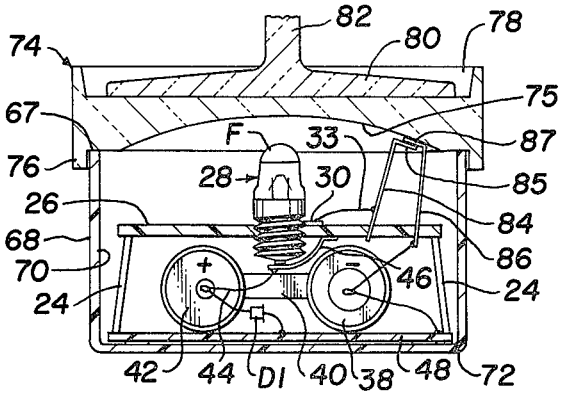
FIG. 6 is a modified form of the invention.

A modified form of the invention is illustrated in FIG. 6. A base 68 having an inner wall 70 and bottom 72 is similar to base 12 except that it has no upper lip. A coaster 74 has an outer flange 76 adapted to fit over the upper end 67 of base 68. A recessed area 78 is adapted to receive a glass 80 having a stem 82. Other types of glassware may be set on coaster 74. The light from bulb 28 is adapted to shine through the coaster 74 and up the stem 82 and into the glass to illuminate the liquid therein.

An alternate form of the switch means generally comprises a phosphor bronze contact 84 extending upwardly from platform 86. Contact 84 is connected to wire 33 and to bulb 28. A second phosphor bronze contact 86 constructed of spring-like material extends upwardly on the platform 26 adjacent contact 84 such that the flanged ends 85 and 87 extend parallel and overlap each other just below the base 75 of coaster 74. Contact 86 has sufficient spring resistance to lift coaster 74 slightly when a glass is not contained in recess 78. The the contact between flanged ends 85 and 87 is broken to turn off light 28. When the glass 80 or a receptacle 10 is placed within the coaster 74, the spring-like material of contact 86 is depressed downwardly such that flanged ends 85 and 87 complete a circuit to energize light 28. The light is conducted up the stem 82 into the liquid to illuminate the liquid and not merely form a light which would glare at people's eyes if coaster 74 were empty. The illuminating device would be extremely useful in illuminating liquids generally used in a stem ware such as wine, champagne or punch.

Figure 7:
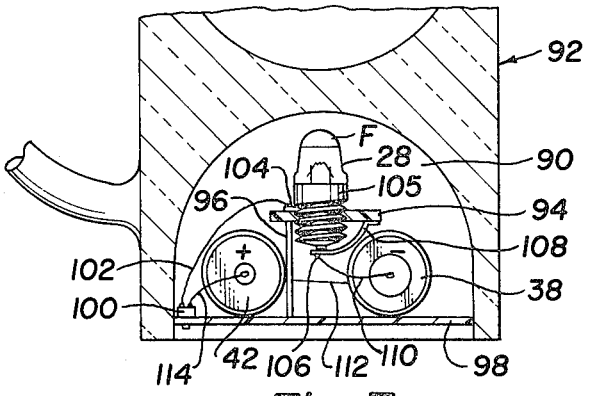
FIG. 7 is a second modified form of the invention.

A still second modified form of the device is illustrated in FIG. 7. A hollow chamber 90 is formed in the bottom of a glass receptacle 92. A lamp 28 is supported on a platform 94 secured on standard 96. The standard 96 extends upwardly from a bottom base 98 adapted to hold batteries 38 and 42 in chamber 90. The switch means generally comprises a single pole, single throw slide switch 100 having one side connected by line 102 to a contact 104 adjacent threaded portion of the base 105 of bulb 28. The tip 106 of bulb 28 engages contact 108 and is connected by line 110 to the negative side of battery 38. Connector 112 connects the positive side of battery 38 to the negative side of battery 42 and the positive side of battery 42 is connected by a line 114 to switch 100. Switch 100 may be turned on or off to illuminate the liquid within the glass receptacle 92 which generally comprises a mug. The batteries 38 and 42 maybe of a rechargeable type or a dry cell as illustrated.

Operation of the hereinbefore described device is as follows:

The preferred embodiment as illustrated in FIG. 1 is operated by positioning base 12 on the charger base housing 58 above one of the designated primary coils in order to charge the batteries 38 and 42. Since each of the coils 60 is loaded electrically it is not necessary to turn the housing 58 on or off when removing the bases 12. The primary portion of the charger will charge one or more bases 12. After batteries 38 and 42 have been fully charged, a drink may be mixed or poured into a glass receptacle 10 having a ring 22 permanently secured to the base thereof. The user would then simply position the ring 22 over the base and snap it into the ridges 20 thus securing the base 12 to the glass receptacle 10. The base 12 also forms a coaster to prevent water rings on furniture.

If it is desired, the electrical portions within the base 12 might be potted with a nonconductive material within the base. A concave region is formed for the light 28 to shine through. After the drink is finished the glass may then be removed to shut off the flow of current to the bulb 28 thus saving the energy within the batteries 38 and 42. The glass may also be stored in an inverted position over the base 12.

It should be understood that the device is intended to illuminate liquid drinks for human consumption in a transparent receptacle 10. The drinks may be non-carbonated or carbonated or alcohol or non-alcohol.

The second modified form illustrated in FIG. 6 is used in a similar manner except that the switch means is controlled by placing a glass upon the coaster 74. As heretofore explained, when the glass is removed the spring-like material of contact 86 will extend upwardly and disengage from the flange 85 of contact 84 thus turning off the light 28 to save energy. This also illuminates any shine into the eyes of the surrounding persons using the device.

Further, another modified form would include a pressure switch in place of the slide switch 100 which would illuminate the glass only when it is setting upon a surface if so desired. A pressure switch would have a plunger, not shown, that extends outwardly from the base 98 such that when it engages a surface and its depressed it would energize the light 28.

In place of annular ring 22 on receptacle 10 an annular ring of decorative metal such as gold, silver or chrome may be bonded to the glass to serve as a conductor between contacts 32 and 34. The metal may be bonded to the glass in many conventional ways; however, it is necessary that the metal extend about the perphery and leave an opening in the center of the bottom of the glass for light to shine through just as ring 22 does.

It should be appreciated that other and further embodiments of the invention may be devised without departing from the basic concept hereof.

It should be further appreciated that each of the embodiments of this invention disclose a copy of the invention herein discussed.

We claim:

1. Apparatus to illuminate a liquid drink contained in a transparent receptacle comprising: a cylindrical hollow base having a lip formed about the upper periphery to grip the bottom portion of a transparent receptacle; an electric power source secured within said base; an electrical light source forming a columnated beam of light positioned to shine through the bottom of the transparent receptacle; an annular, conductive ring secured to the bottom of said transparent receptacle; and a pair of flexible contacts, one contact secured to one pole of said power source and the other contact secured between said light source and extending upwardly to an upper edge of said base, and arranged such that said contacts engage said ring when the transparent receptacle to form a complete circuit in energize the light source such that a columnated beam of light is shining through the bottom of the transparent receptacle to illuminate the liquid contained therein.

2. Apparatus according to claim 1 wherein said electric power source comprises: rechargeable batteries.

3. Apparatus according to claim 2 including: a battery charger comprising: a charger base; a primary coil recured in said charger base adapted to produce an electromagnetic field when an alternating current is applied; a secondary coil secured in said base and operably secured to said rechargeable batteries to apply a current across said batteries when positioned adjacent said primary coil in said charger base; and a rectifying circuit operably secured between said batteries and secondary coil.

4. Apparatus according to claim 3 wherein said primary coil and said secondary coil comprise: a flat printed circuit board having a helically formed circuit formed thereon to produce a spirally wound flat coil.

5. Apparatus according to claim 3 wherein said charger base has a recessed pocket formed in the upper surface thereof to receive said base; a plurality of helically wound coils position around said recessed pocket throughout the depth of said recessed pocket; and a helically would coil formed along the interior surface of said base and connected to said batteries such that when the base is positioned in said recessed pocket, a current is formed across the coil to charge the batteries.

6. Apparatus according to claim 1 wherein said switch means comprises: a single pole, single throw switch.

* * * * *